US007743916B2

(12) United States Patent
Roberts, II

(10) Patent No.: US 7,743,916 B2
(45) Date of Patent: Jun. 29, 2010

(54) ORNAMENTAL GOLF BAG COVER

(76) Inventor: Peter A. Roberts, II, 10394 Rochester Ave., #8, Los Angeles, CA (US) 90024

( * ) Notice: Subject to any disclaimer, the term of this patent is extended or adjusted under 35 U.S.C. 154(b) by 137 days.

(21) Appl. No.: 12/080,612

(22) Filed: Apr. 4, 2008

(65) Prior Publication Data

US 2009/0250148 A1 Oct. 8, 2009

(51) Int. Cl.
*A63B 57/00* (2006.01)
*A63B 55/06* (2006.01)

(52) U.S. Cl. ..... 206/315.3; 206/315.4; 206/315.6; 206/457; 150/159; 190/26

(58) Field of Classification Search ..... 206/315.4, 206/315.7, 315.3, 457; 150/159, 154; 224/645; 190/18 R, 26; 248/96, 97
See application file for complete search history.

(56) References Cited

U.S. PATENT DOCUMENTS

| | | | | | |
|---|---|---|---|---|---|
| 2,985,212 | A | * | 5/1961 | Dozier | 150/159 |
| 3,754,587 | A | * | 8/1973 | Rainieri | 150/159 |
| 3,771,192 | A | * | 11/1973 | Zaleski | 15/330 |
| 4,953,768 | A | * | 9/1990 | Muse | 224/613 |
| D314,863 | S | * | 2/1991 | Brengel | D3/321 |
| D341,485 | S | * | 11/1993 | Brengel | D3/255 |
| 5,274,901 | A | * | 1/1994 | Sanders | 29/525.01 |
| 5,383,505 | A | * | 1/1995 | Cordasco, Jr. | 150/159 |
| 5,390,717 | A | * | 2/1995 | Schenker et al. | 150/159 |
| D409,833 | S | * | 5/1999 | Coward, III | D3/255 |
| 5,904,196 | A | * | 5/1999 | Wickers | 150/165 |
| 6,126,240 | A | * | 10/2000 | Tse | 297/461 |
| 2005/0205180 | A1 | * | 9/2005 | Goudeau | 150/154 |

* cited by examiner

*Primary Examiner*—Sue A Weaver
(74) *Attorney, Agent, or Firm*—Morland C. Fischer

(57) ABSTRACT

A removable golf bag cover having an ornamentally-pleasing shape (e.g., that of a dog or other animal) to surround a conventional golf bag without affecting the normal use of the bag during play. The golf bag cover includes legs extending from an elongated body of the cover which surround corresponding outstretched folding legs of the golf bag. A hollow head of the golf bag cover is pivotally coupled to the elongated body of the cover by a piece of flexible material that is adapted to stretch. The hollow head is rotatable from a closed position seated on top of the golf bag, at which to surround an protect the golf clubs carried within the bag, and an open position off the bag, at which to enable a golfer to gain access to his clubs. At least one golf club carried in the bag is received inwardly of and holds the hollow head in a generally erect condition relative to the elongated body of the cover.

7 Claims, 4 Drawing Sheets

ORNAMENTAL GOLF BAG COVER

BACKGROUND OF THE INVENTION

1. Field of the Invention

This invention relates to an ornamentally-pleasing, removable golf bag cover (e.g., having the appearance of a dog or other animal) to surround a conventional golf bag without affecting the normal use of the bag during play or hindering the golfer's access to his clubs carried in the bag.

2. Background Art

Golf bags have long been used by golfers to carry golf clubs and other golf-related accessories during a round of golf. The majority of conventional golf bags include a hollow cylindrical body having an open top through which to receive the golf clubs to be transported from hole to hole. The conventional golf bag usually includes rotatable front and back folding legs which may be unfolded to establish a stand for holding the bag generally upright and avoid the golfer having to bend over to pick up the bag.

Most golf bags look alike and, in many cases, it is hard to distinguish one golfer's bag from another. In other cases, should the conventional golf bag be left outside in the rain, the cylindrical body thereof may begin to fill with water. Accordingly, what would be desirable is an ornamentally-pleasing, removable golf bag cover to surround a golf bag and enclose the golf clubs carried therein for enabling a golfer to individualize and distinguish his bag from those of other golfers.

SUMMARY OF THE INVENTION

In general terms, an ornamentally-pleasing golf bag cover is disclosed to surround a conventional golf bag of the kind commonly used to carry a set of golf clubs. By way of example, the golf bag cover has an appearance resembling that of a dog. The golf bag cover includes an elongated body that is sized to enclose the golf bag. A pair of hollow front legs extend from the top of the body of the golf bag cover, and a pair of rear feet extend from the bottom of the cover. When the cover surrounds the golf bag, a pair of front folding legs that are hingedly connected to the golf bag are received within respective ones of the hollow front legs extending from the body of the golf bag cover. The outstretched front legs of the golf bag that are located within and surrounded by the legs of the golf bag cover form a stand for holding the cover in a generally-upright position to resemble the appearance of a sitting dog.

The golf bag cover includes a soft (e.g., plush) hollow head pivotally connected to the top of the elongated body of the cover by means of a piece of elastic material that is capable of stretching in response to a pulling or pushing force applied to the head. The hollow head is rotatable at the piece of elastic material between a closed position seated on the open top of the golf bag, at which to enclose and protect the golf clubs carried therein, and an open position moved off the golf bag, at which to permit access to the clubs carried in the bag. The clubs in the golf bag cooperate with the soft, hollow head of the golf bag cover to prevent the head from collapsing over and around the open top of the golf bag by holding the head in a generally erect condition.

A main zipper fastener runs longitudinally along the front of the elongated body of the golf bag cover. The main zipper fastener is opened when it is desirable to remove the golf bag from or locate the golf bag within the golf bag cover. Auxiliary zipper fasteners are included on the golf bag cover to permit access through the cover to pockets and storage compartments of the golf bag. Openings are formed in the golf bag cover at the back thereof opposite the main zipper fastener to accommodate buckles therethrough by which a standard shoulder harness can be coupled to the golf bag lying below the golf bag cover.

DESCRIPTION OF THE PREFERRED EMBODIMENT

Figure 1:
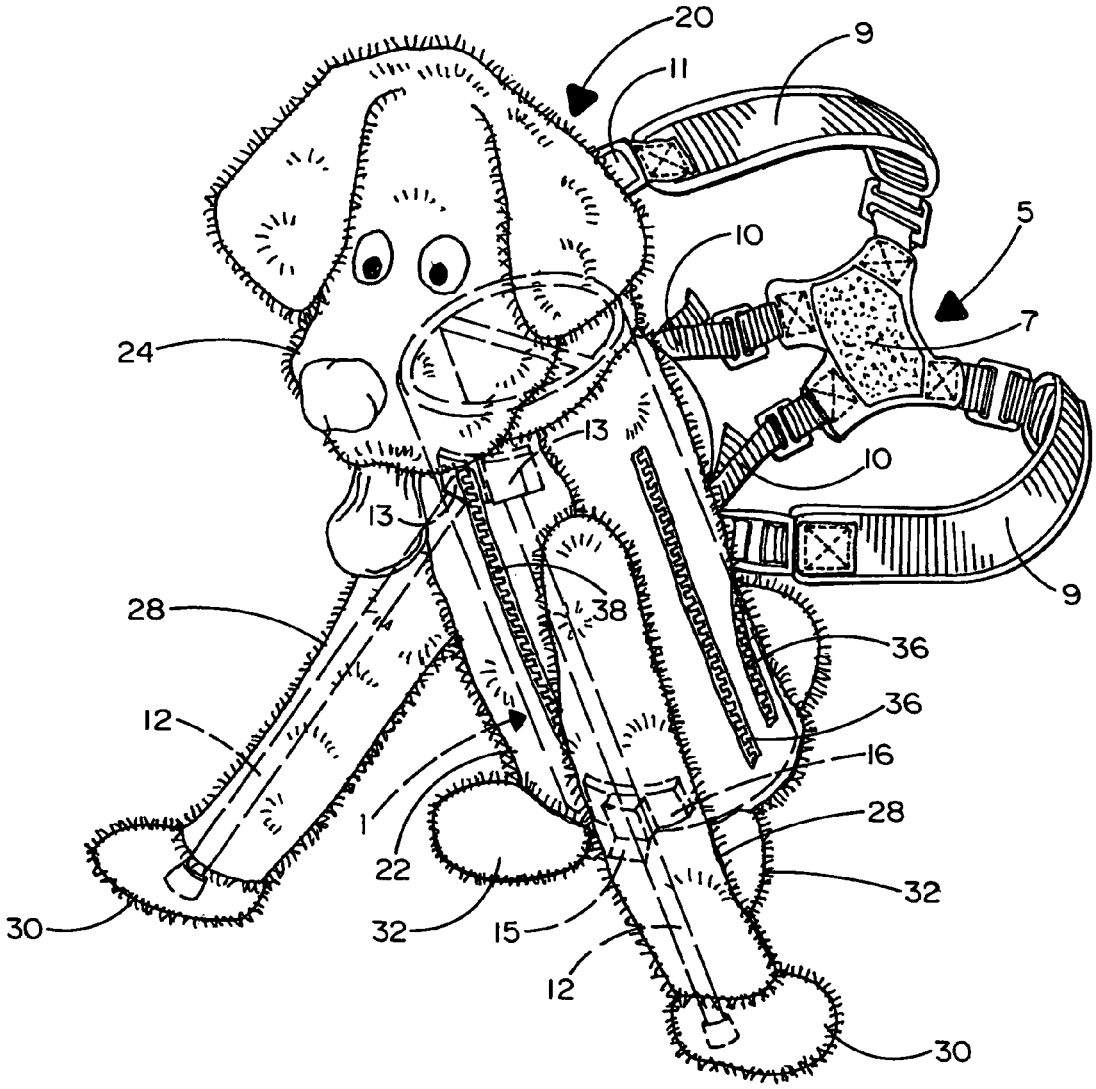
FIG. 1 is a perspective view showing a golf bag cover according to a preferred embodiment of this invention having an ornamentally-pleasing shape (e.g., that of a sitting dog) and surrounding a conventional golf bag.

Referring concurrently to FIGS. 1-4 of the drawings, there is shown a golf bag 1 enclosed by an ornamental golf bag cover 20 according to a preferred embodiment of this invention. The golf bag 1 is conventional and is commercially-available from a golf shop, sporting goods store, or the like. Thus, the golf bag 1 is typically used to enable a golfer to carry a variety of golf clubs 3 (best shown in FIG. 3). As is customary, the golf bag 1 typically has a carrying handle 4 as well as a shoulder harness 5 to be used to facilitate the golfer transporting the bag behind his back. For the golf bag 1, the harness 5 includes a back pad 7, a pair of shoulder straps 9, a set of tie straps 10, and buckles 11 by which the harness 5 is detachably connected to the bag 1. However, it is to be understood that the specific details of the golf bag 1 and the harness 5 attached thereto do not form any part of the present improvement.

Figure 3:
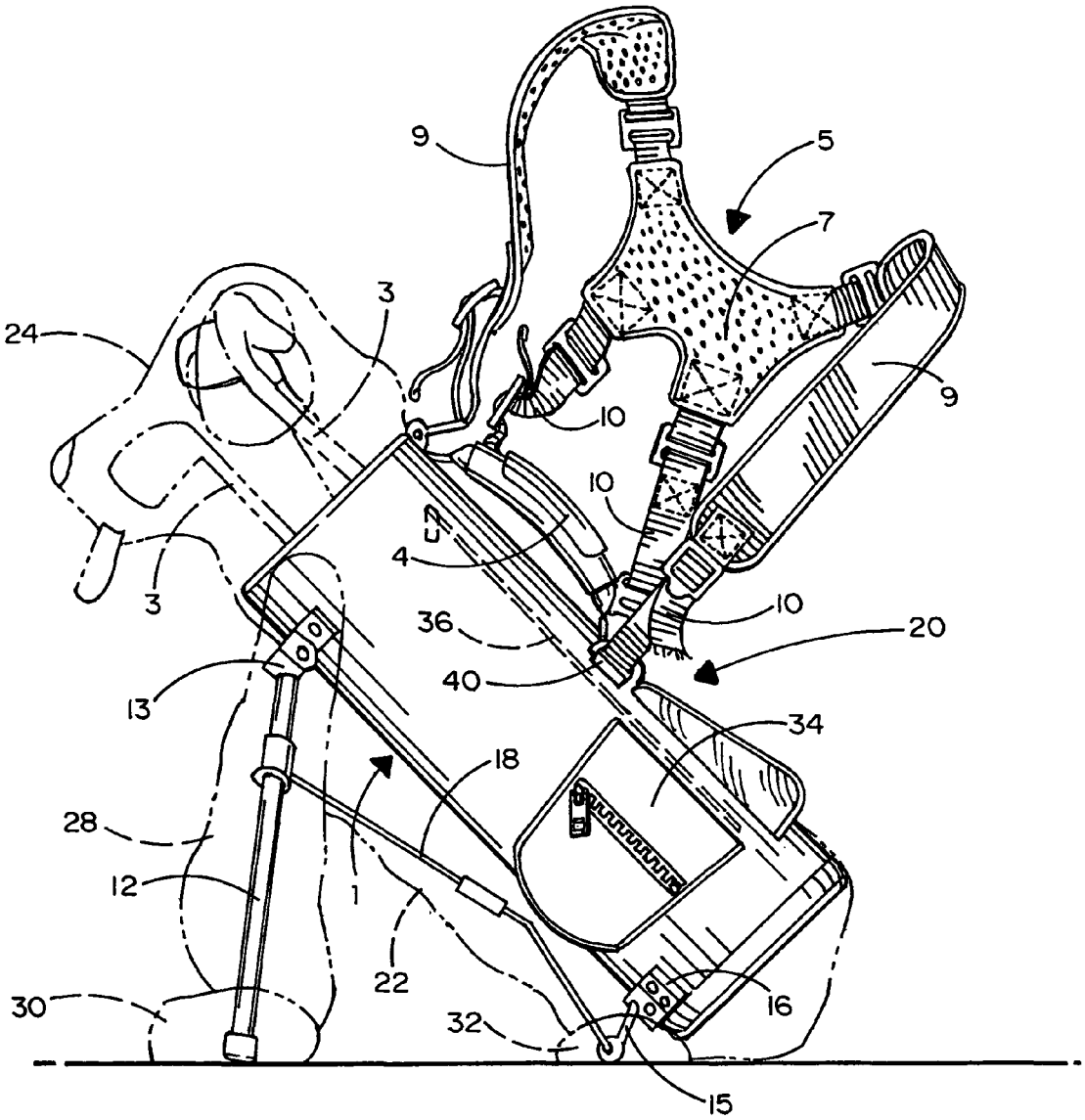
FIG. 3 illustrates the manner in which the golf bag is surrounded by the golf bag cover of the present invention.

As is best shown in FIGS. 1 and 3, the golf bag 1 has a plurality of standard folding legs which enable the bag to stand generally upright when not in use or while the golfer is at play. A pair of front legs 12 are pivotally connected near the top of bag 1 by hinges 13. A single back leg or rest 15 is pivotally connected near the bottom of the bag 1 by a hinge 16. A brace 18 is connected between each front leg 12 and the back leg 15. The legs 12 and 15 are rotatable at their respective hinges 13 and 16 between an outstretched position (as shown) when it is desirable to have the bag 1 stand upright and a folded position (not shown) when it is desirable to store or transport the bag away from a golf course.

According to the preferred embodiment, the golf bag cover 20 which surrounds the existing golf bag 1 has the ornamentally-pleasing shape of a dog. However, this particular shape is not to be regarded as a limitation of the present invention, and different shapes including other animals, and the like, may also be represented. The size of golf bag cover 20 will vary depending upon whether the cover 20 is used to surround the golf bag of a child or an adult.

Figure 4:
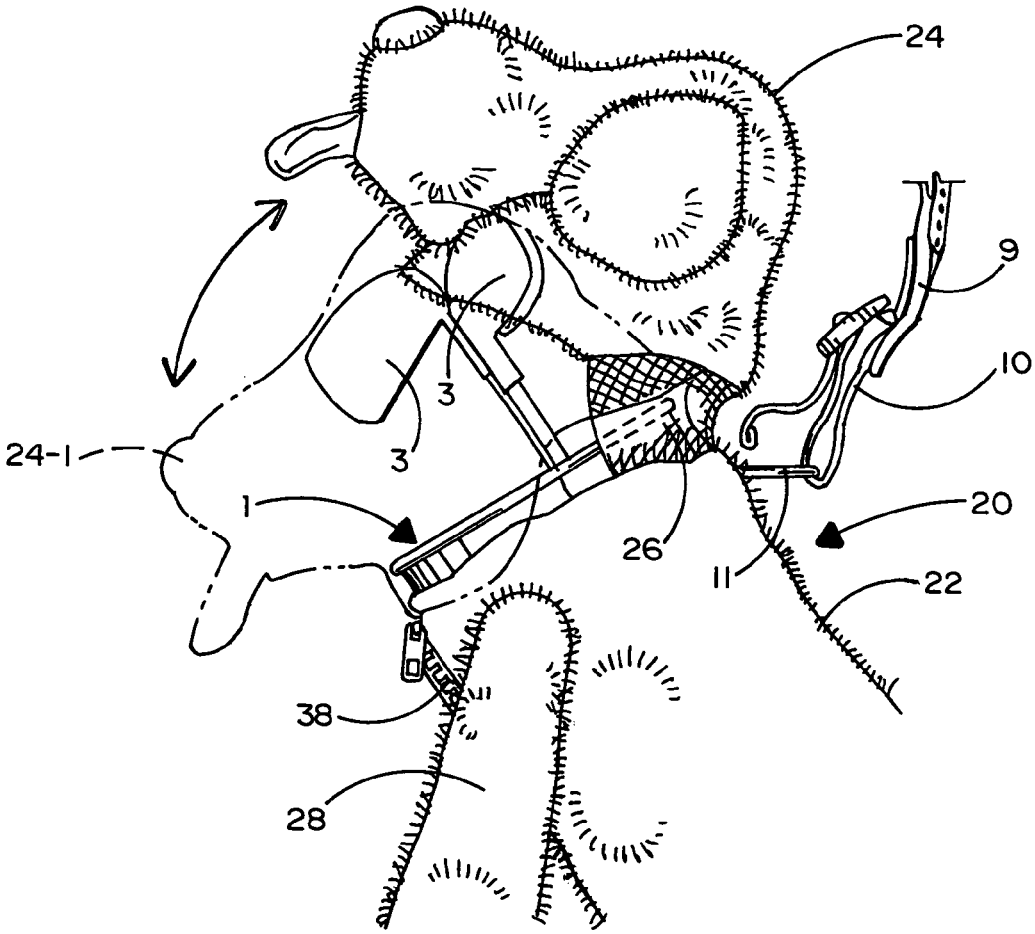
FIG. 4 shows a head of the golf bag cover pivotally coupled to a body of the cover and rotatable relative to the body between closed and opened positions.

The golf bag cover 20 includes an elongated body 22 that is dimensioned to accommodate the golf bag 1 therewithin. Located at one end (i.e., the top) of body 22 is a hollow head 24. In the present example, the head is shaped to resemble the head of a dog. As is best shown in FIG. 4, the head 24 of cover 20 is pivotally connected to the body 22 by means of a piece of elastic material 26 that is capable of stretching in response to a pulling or pushing force applied to the head 24. Thus, the head 24 of golf bag cover 20 can be rotated at the piece of elastic material 26 from a closed position seated upon the top of the golf bag 1 (shown in phantom lines designated 24-1 in FIG. 4) and an open position off the golf bag 1.

With the hollow head 24 rotated to the closed position seated on top of the golf bag 1, any golf clubs 3 that are located in and extend upwardly from the golf bag will be surrounded and protected from the elements. When the hollow head 24 is rotated to the open position off the golf bag 1, the golfer will be able to remove, replace or substitute the golf clubs 3 that are carried in the bag 1. To this end, the elastic nature of the material 26 allows the head 24 to be pulled upwardly relative to the body 22 of cover 20 and off the clubs 3 to facilitate a rotation of the head 24 between the aforementioned closed and open positions.

In some cases, the elongated body 22 and the hollow head 24 of the golf bag cover 20 may be manufactured from a soft or plush material that is incapable of independently maintaining its shape. That is to say, in the event that no golf clubs are located within the golf bag 1, the head 24 of cover 20 will simply collapse over and around the top of the golf bag 1. To overcome this problem, and as an important feature of the present invention, the head 24 of cover 20 is dimensioned to receive therewithin and lay upon at least one golf club being carried in and extending upwardly from the golf bag 1. More particularly, one or more golf clubs 3 in golf bag 1 will cooperate with the hollow head 24-1 in the closed position of FIG. 4 to preserve the shape of head 24-1 and thereby enhance the overall aesthetic appearance of the golf bag cover 20 by holding the head 24-1 above the golf bag 1 and in upstanding erect alignment with respect to the elongated body 22 of cover 20.

The elongated body 22 of golf bag cover 20 includes a pair of hollow extensions or front legs 28 projecting from cover 20 below the head 24. A relatively wide foot 30 is located at the outermost end of each leg 28. As is best shown in FIG. 3, the legs 28 and feet 30 of body 22 are dimensioned to receive therewithin respective ones of the outstretched folding front legs 12 of the golf bag 1. The front legs 12 of golf bag 1 maintain the shape of golf bag cover 20 and provide support to hold the golf bag cover 20 in an upright position around the golf bag 1.

The elongated body 22 of golf bag cover 20 also includes a pair of pads or rear feet 32 located near the bottom of body 22. In this case, the rear feet 32 are included for ornamental purposes only.

The braces 18 (only one of which being shown) between each front leg 12 and the back leg 15 of the golf bag 1 are received inwardly of the elongated body 22 of golf bag cover 20. Therefore, it may be appreciated that the existing front and back legs 12 and 15, the braces 18 extending therebetween, and the remainder of the conventional golf bag 1 are all surrounded by the ornamentally-pleasing golf bag cover 20 of the present invention to give the appearance of (in the present example) a sitting dog.

Any number of external pockets 34 (best shown in FIG. 3) may be attached (e.g., sewn) to the body 22 of the golf bag cover 20 to enable the golfer to store and carry items (e.g., balls, tees, etc.) necessary to play the game of golf. In this same regard, the body 22 includes a set of short auxiliary zipper fasteners 36 which may be opened to enable the golfer to gain access to the internal pockets and similar storage compartments that are part of the conventional golf bag 1 and lie inside the golf bag cover 20.

A relatively long main zipper fastener 38 (best shown in FIGS. 1 and 2) runs longitudinally along the front of the body 22 of golf bag cover 20. A zipper fastener 38 is preferred, because it may be quickly and easily manipulated by the golfer. However, other suitable fasteners (e.g., hook and loop Velcro strips, buttons, snaps, etc.) may also be used in substitution of zipper 38. The main zipper fastener 38 is opened when it is desirable to locate the golf bag 1 within or remove the golf bag 1 from the golf bag cover 20.

Figure 2:
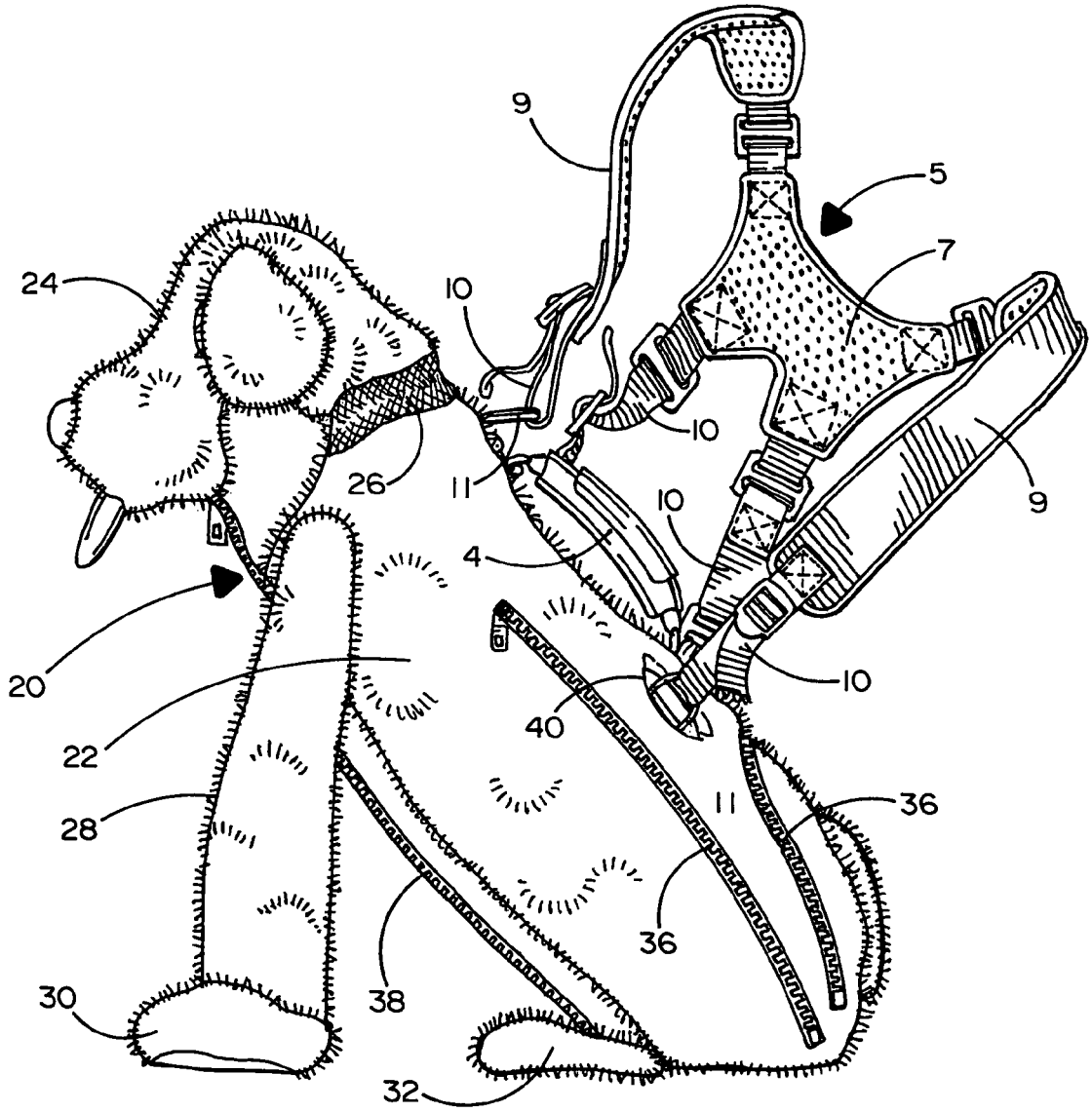
FIG. 2 is a side view of the golf bag cover shown in FIG. 1.

As is best shown in FIG. 2, openings 40 are created at the back of the body 22 of golf bag cover 20 opposite the main zipper fastener 38. The openings 40 are sized to accommodate therethrough the buckles 11 which permit the standard shoulder harness 5 to be connected to the golf bag 1 inside the cover 20. Thus, it may be appreciated that surrounding the golf bag 1 by the golf bag cover 20 of this invention will not interfere with the golfer's normal use of the bag during play or hinder access to his clubs 3 that are carried within the bag 1. At the same time, the ornamental features of the golf bag cover 20 will customize the golf bag 1 and enhance the golfer's enjoyment of the game. During off season or depending upon the golfer's mood, the main zipper fastener 38 can be opened so that the bag 1 is removed from the golf bag cover 20 for storage or for use without the cover.

The invention claimed is:

1. A combination comprising:

a golf bag in which golf clubs are to be carried, said golf bag having an open top and a closed bottom and a pair of folding legs rotatable from a collapsed folded position to an outstretched unfolded position to create a stand to hold said golf bag in a generally upright condition; and a golf bag cover having a body shaped like and having the appearance of an animal to surround and hide the identity of the golf bag, said body having a pair of hollow flexible legs shaped like and having the appearance of the legs of the animal to receive therewithin and enclose respective ones of the pair of folding legs of the golf bag, the flexible legs of said body rotating with the folding legs of the golf bag as said folding legs rotate between said collapsed folded and outstretched unfolded positions, said golf bag cover also having a head shaped like and having the appearance of the head of the animal and positioned over the golf bag to close the open top thereof, said head being pivotally attached to the body of said golf bag cover so that said head is rotatable relative to said body between a closed position lying over the open top of the golf bag to prevent access to the golf clubs carried therein and an open position moved off the open top to permit access to the golf clubs.

2. The combination recited in claim 1, wherein said golf bag cover includes elastic material by which the head of said golf bag cover is pivotally attached and rotatable relative to said body thereof without detaching said head from said body, said elastic material adapted to stretch when a pulling force is applied to said head so as to cause said head to rotate from said closed position to said open position.

3. The combination recited in claim 1, further comprising at least one golf club carried by said golf bag and extending outwardly from the open top thereof, the head of said golf bag cover being manufactured from a soft, collapsible plush material that is incapable of maintaining its shape, and the at lest one golf club engaging the head of said golf bag cover for preventing said head from collapsing and holding said head in a generally erect position relative to the body of said cover so as to lie in axial alignment therewith.

4. The combination recited in claim 3, wherein the head of said golf bag cover is hollow, said at least one golf club being received inwardly of and enclosed by said hollow head, whereby said golf club prevents said head from collapsing and holds said head in said generally erect position.

5. The combination recited in claim 1, further comprising a shoulder harness to be worn by a golfer to transport said golf bag and said golf bag cover surrounding said golf bag, the body of said golf bag cover having an opening formed therethrough, and said shoulder harness being attached to said golf bag by way of said opening through said golf bag cover.

6. The combination recited in claim 1, further comprising at least one fastener located on the body of said golf bag cover, said fastener being opened to permit said golf bag to be located inside or removed from said body.

7. The combination recited in claim 1, wherein the body of said golf bag cover has at least one fastener which is opened to permit access to a storage compartment of said golf bag which lies below said one fastener.

* * * * *